US005742051A

United States Patent [19]

Bergen

[11] Patent Number: 5,742,051

[45] Date of Patent: Apr. 21, 1998

[54] MICRO SIZED ION GENERATING DEVICE

[75] Inventor: Richard F. Bergen, Ontario, N.Y.

[73] Assignee: Xerox Corporation, Stamford, Conn.

[21] Appl. No.: 720,278

[22] Filed: Sep. 26, 1996

[51] Int. Cl.[6] ..... H05F 3/06

[52] U.S. Cl. ..... 250/326; 361/213; 422/186.06

[58] Field of Search ..... 250/326, 325, 250/324; 361/213, 229, 225, 230, 233; 422/186, 186.04, 186.06

[56] References Cited

U.S. PATENT DOCUMENTS

| | | | |
|---|---|---|---|
| 4,574,326 | 3/1986 | Myochin et al. | 250/326 |
| 4,783,716 | 11/1988 | Nagase et al. | 250/326 |
| 4,963,738 | 10/1990 | Gundlach et al. | 250/326 |
| 4,999,733 | 3/1991 | Kakuda | 250/325 |
| 5,153,435 | 10/1992 | Greene | 250/326 |
| 5,407,639 | 4/1995 | Watanabe et al. | 250/326 |

OTHER PUBLICATIONS

Publication: "Additive Direct Writing: An Emerging Technology" by Walter M. Mathias, Micropen, Inc., Pittsford, NY, 4 pgs. No Page Number and No Date.

*Primary Examiner*—Kiet T. Nguyen
*Attorney, Agent, or Firm*—William A. Henry, II

[57] ABSTRACT

A copier/printer includes a micro sized ion generating device that includes an insulated support substrate having an edge portion. An AC coronode covered by an insulated member is mounted on the edge portion of the support substrate, and a DC biased screen is on top of the insulated member, completes the device.

12 Claims, 3 Drawing Sheets

MICRO SIZED ION GENERATING DEVICE

BACKGROUND OF THE INVENTION

The present invention relates generally to an electrostatographic printing machine and, more particularly, concerns a corona generating device for use in such a machine.

The basic reprographic process used in an electrostatographic printing machine generally involves an initial step of charging a photoconductive member to a substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer material including toner particles adhering triboelectrically to carrier granules into contact with the latent image. The toner particles are attracted away from the carrier granules to the latent image, forming a toner image on the photoconductive member which is subsequently transferred to a copy sheet. The copy sheet having the toner image thereon is then advanced to a fusing station for permanently affixing the toner image to the copy sheet in image configuration.

In electrostatographic machines, it has been found that consistent reproductive quality can only be maintained when a uniform and constant charge potential is applied to the photoconductive surface. In many automatic machines of this type, a single wire generator, generally referred to as a "corotron" is employed. Generally, the efficiency of the corotron is dependent n many factors including the gap distance between the wire and the photoconductive member surface, the nature of the generating wire material, the diameter of the wire and other physical features thereof and the amount of energy supplied to the corona emitter. Heretofore, these corona devices required large power supplies to meet high current and voltage requirements, were costly and took up a large area of machine space. These units were sufficient in the past, but with present need for copier/printers that produce a more uniformly charged surface, use less energy, are less costly, changes in corona generating devices are required. In addition, with the advent of small diameter photoconductive rollers being used as imaging members, the need much for smaller charging/transfer/detack devices, arises.

A simple, relatively inexpensive, and accurate approach to eliminate the above mentioned problems, in such copier/printing systems, has been a goal in the design, manufacture and use of electrophotographic printers and copiers. Further, the need to provide accurate and inexpensive charging systems has become more acute, as the demand for high quality, relatively inexpensive electrophotographic printers has increased.

Various techniques for charging have hereinbefore been devised as illustrated by the following disclosures, which may be relevant to certain aspects of the present invention:

Corona charging of xerographic photoreceptors has been disclosed as early as U.S. Pat. No. 2,588,699. It has always been a problem that current levels for practical charging require coronode potentials of many thousands of volts, while photoreceptors typically cannot support more than 1000 volts surface potential without dielectric breakdown.

One attempt at controlling the uniformity and magnitude of corona charging is U.S. Pat. No. 2,777,957 which makes use of an open screen as a control electrode, to establish a reference potential, so that when the receiver surface reaches the screen voltage, the fields no longer drive ions to the receiver, but rather to the screen. Unfortunately, a low porosity screen intercepts most of the ions, allowing a very small percentage to reach the intended receiver. A more open screen, on the other hand, delivers charges to the receiver more efficiently, but compromises the control function of the device.

Other methods exist for trying to obtain uniform charging from negative charging systems, such as dicorotron charging devices as shown in U.S. Pat. No. 4,086,650 that include glass coated wires and large specialized AC power supplies. Devices for modulating ions include U.S. Pat. Nos. 4,425,035 and 4,562,447 which disclose an ion modulating electrode for an electrostatic recording apparatus. The ion modulating electrode includes a continuous layer of conductive material and a segmented layer of conductive material separated from each other by an insulating layer. The insulating layer includes a plurality of apertures, which may be bored by a laser beam, through which the ions flow. U.S. Pat. No. 2,932,742 discloses an apparatus for charging a xerographic plate and has a screen electrode consisting of alternating conductive areas having open spaces therebetween. U.S. Pat. No. 4,841,146 is directed to a self cleaning charging unit that includes an insulating housing and a current limited, low capacitance corona wire positioned within the housing and located 0.5–6 mm away from biased conductive plates which form a slit through the bottom of the housing that allows ions to pass therethrough onto a receptor surface. These devices have not been entirely satisfactory since some of these are costly, while others are difficult to fabricate, are quite large, and most are inefficient.

A scorotron charging device that meets some of the above deficiencies is U.S. Pat. No. 4,963,738 which is directed to a charging device having a coronode that includes a comb-like ruthenium glass electrode silk screened onto a supporting dielectric substrate. The teeth of the comb-like electrode extend to an edge of the dielectric substrate and positionable relative to a screen or slit in order to form a scorotron. But, the problem with this unit is that it requires three structures (a corotron generator, insulator and counter electrode) to be carefully aligned in a support frame.

Present slit type scorotrons require precise alignment of at least three parts in a support frame. For example, the charging unit in U.S. Pat. No. 4,963,738 requires exact alignment of the charging elements, the insulator element and the reference electrode. An electrode cooperates with and is positioned adjacent to reference electrode in order to form a slit through which ions are emitted. The device includes a flat scorotron positioned in a horizontal plane above a charge retentive surface supported on a grounded conductor and a high voltage supply is connected to buss bar which in turn, is connected to a comb-like member having coronode lines 14. Electrodes and reference electrodes are used for potential leveling.

U.S. Pat. No. 5,153,435 discloses a charging device in which the need for precise alignment of parts is eliminated. The rigid, one-piece, slotted scorotron comprises a substrate of a thin planar piece of alumina with a ruthenium comb-like pattern on one side, and a solid conductor on the opposite side. Alumina substrate has machined, staggered slots, e.g., formed by the use of lasers, therein that form a series of slits that allow ion flow. Each slot serves the function of the slit in U.S. Pat. No. 4,963,738, i.e., the terminated ruthenium tips of fingers are the corona source, and the solid metal electrode provides the pumping fringe fields and the reference potential. U.S. Pat. No. 4,558,221 is directed to a miniaturized self limiting corona generator for charging a receiver surface and includes a plurality of corona emitting wires housed in respective biased conductive shields with the wires being spaced farther from the receiver surface than the wire-to-shield spacing in order to provide self limiting of surface potential on the receiver surface. All of the above-mentioned references are incorporated herein by reference.

SUMMARY OF THE INVENTION

Accordingly, there is provided a printing machine adapted to print images of page image information onto copysheets. The printer includes a corona generating device comprising an insulated support substrate having an edge portion, said edge portion of said insulated substrate having an AC coronode surrounded by an insulated member mounted thereon, and wherein a DC biased screen member holds said coronode on said edge portion of said insulated support substrate by extending over and around a portion of said insulated member and coronode while being attached to said insulated support substrate.

There also is provided a method for producing a micro sized ion generating device by using additive direct writing technology with the ion generating device being adapted to charge the surface of an imaging member, comprising the steps of: a) providing an insulated substrate having an edge thereof; b) writing a conductive line on said edge of said insulated substrate; c) writing over said conductive line with an insulating layer; d) and then writing a screen pattern over the composite of step c).

BRIEF DESCRIPTION OF DRAWINGS

The foregoing and other features of the instant invention will be more apparent from a further reading of the specifications, claims and from the drawing in which:

DETAILED DESCRIPTION OF EMBODIMENTS

While the present invention is described hereinafter with respect to a preferred embodiment, it will be understood that this detailed description is not intended to limit the scope of the invention to that embodiment. On the contrary, the description is intended to include all alternatives, modifications and equivalents as may be considered within the spirit and scope of the invention as defined by the appended claims.

Figure 3:
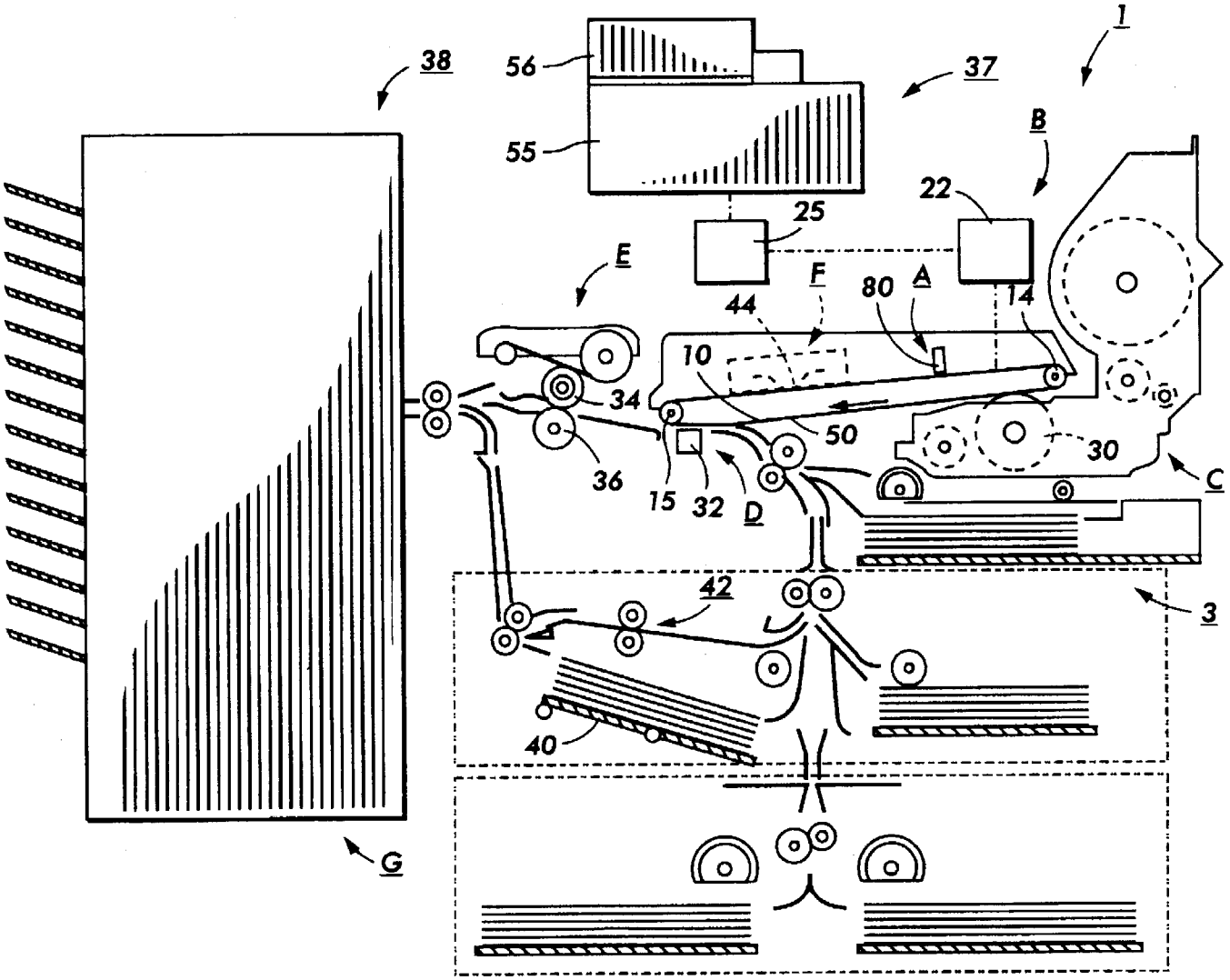
FIG. 3 is a schematic, elevational view depicting an illustrative electrophotographic printing machine incorporating the ion generating device of the present invention.

A schematic elevational view showing an exemplary electrophotographic printing machine incorporating the features of the present invention therein is shown in FIG. 3. It will become evident from the following discussion that the present invention is equally well-suited for use in a wide variety of copying and printing systems.

FIG. 3 schematically depicts an illustrative electrophotographic printing machine, such as disclosed in U.S. Pat. No. 5,258,817, the contents of which are incorporated by reference herein. While a specific printing machine is shown and described, the present invention may be used with other types of printing systems. Specifically, the printing machine 1 of FIG. 3 has both a copy sheet transport system 3 for transporting sheets of material such as paper, mylar and the like, to and from processing stations of the machine 1. The machine 1, has conventional imaging processing stations associated therewith, including a charging station A, an imaging/exposing station B, a development station C, a transfer station D, a fusing station E, a cleaning station F and a finishing station G. The machine 1 has a photoconductive belt 10 with a photoconductive layer 50. The belt 10 is entrained about a drive roller 14 and a tension roller 15. The drive roller 14 functions to drive the belt in the direction indicated by arrow 18. The drive roller 14 is itself driven by a motor (not shown) by suitable means, such as a belt drive.

The operation of the machine 1 can be briefly described as follows:

A document is scanned by compact scanner 37 with a sensing array. The array provides image signals or pixels representative of the image scanned which after suitable processing by processor 15, are output to light source 22. Processor 15 converts the analog image signals output by the array to digital and processes the image signals as required to enable machine 1 to store and handle the image data in the form required to carry out the job programmed. Processor 15 also provides enhancements and changes to the image signals such as filtering, thresholding, screening, cropping, reduction/enlarging, editing, etc.

The photoconductive belt 10 is charged at the charging station A by a corona generating device 80 of the present invention. The charged portion of the belt is then transported by action of the drive roller 14 to the imaging/exposing station B where a latent image is formed on the belt 10 by light source 22. In this case, it is preferred that the light source is a raster output scanning device (a ROS) which is driven in response to signals from processor 15.

The portion of the belt 10 bearing the latent image is then transported to the development station C where the latent image is developed by electrically charged toner material from a magnetic developer roller 30 of the developer station C. The developed image on the belt is then transported to a transfer station D where the toner image is transferred to a copy sheet substrate transported in the copy sheet transport system 3. In this case, a corona generating device 32 is provided to attract the toner image from the photoconductive belt 10 to the copy sheet substrate. The copy sheet substrate with image thereon is then directed to the fuser station E. The fuser at station E includes a heated fuser roll 34 and backup pressure roll 36. The heated fuser roll and pressure roll cooperate to fix the image to the substrate. The copy sheet then, as is well known, may be selectively transported to an output tray (not shown) through a finishing device 38 or along a selectable duplex path including apparatus for buffered duplexing and for immediate duplexing (i.e., tray 40 and path 42 in the case of the illustrative printing machine of FIG. 3). The portion of the belt 10 which bore the developed image is then transported to the cleaning station F where residual toner and charge on the belt is removed in a conventional manner by a blade edge 44 and a discharge lamp (not shown). The cycle is then repeated.

Figure 1:
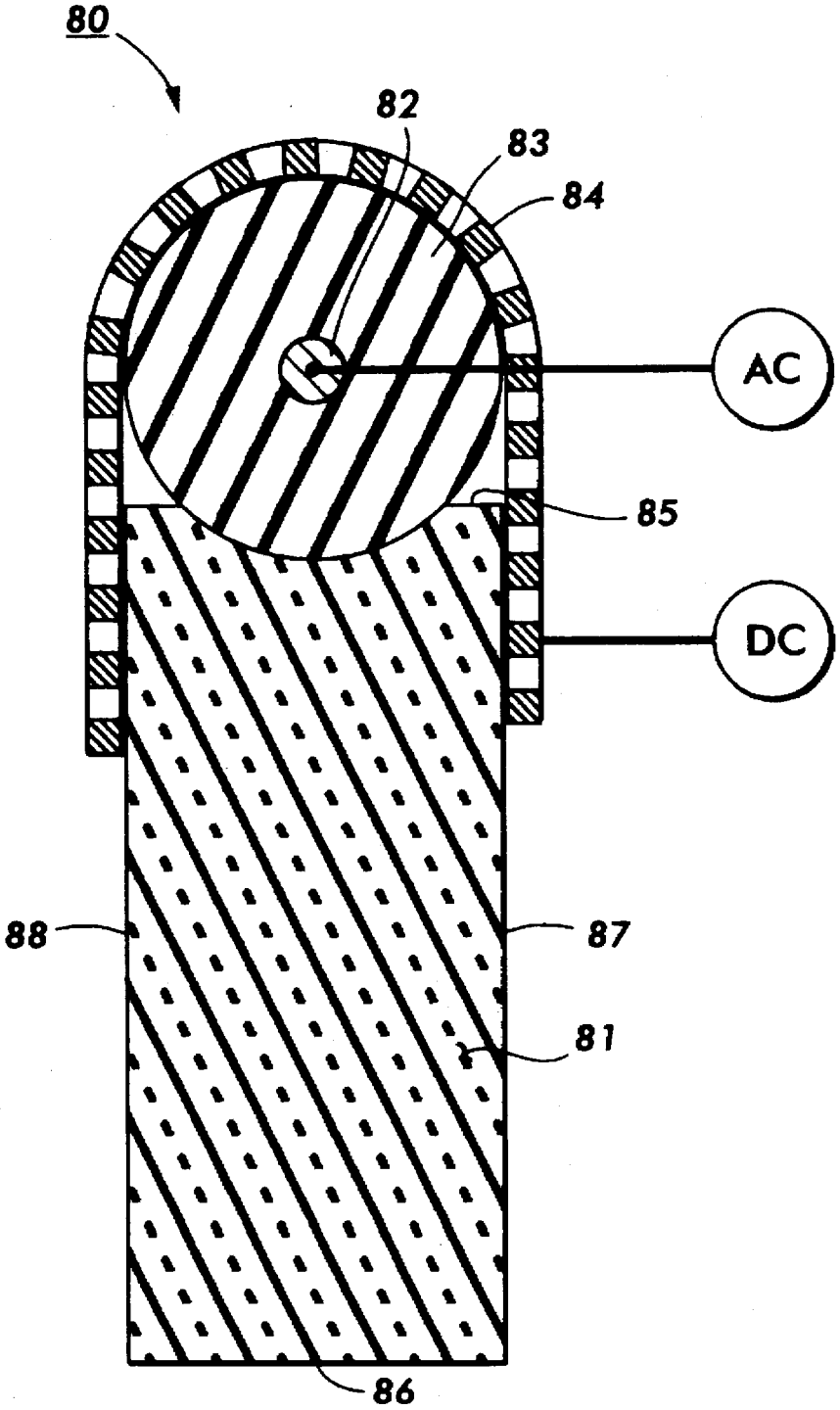
FIGS. 1 and 2 are side views of different embodiments of the ion lo generating device of the present invention.

With reference to FIG. 1, micro sized ion generating device 80 includes a rectangular, 25 mil thick support substrate 81 that is made of an insulating material. Insulated substrate 81 is defined by upstanding side walls 87 and 88, a bottom member 86, and a top edge portion 85. An AC coronode 82 having insulation 83 therearound is positioned on top of edge portion 85. A conductive and DC biased screen 84 is positioned and bent around insulation 83 and coronode 82 in order to hold coronode 82 on top of edge portion 85 of insulated support substrate 81. Screen 84 is DC biased and coronode 82 is AC biased for optimum results. Coronode 82 is preferably constructed of a 0.0015 to 0.002 inch diameter wire that requires only a miniature power supply. Screen 84 provides charge leveling capability and scorotron like qualifies.

In operation of the present invention, the AC coronode on top of the insulating substrate generates corona within apertures of the screen. DC potential applied to the screen provides charge driving and leveling forces as ions are directed toward the charge receptive surface. Voltage on the screen drives the ions to the charge receptive surface.

It should be evident that the present invention could be also employed in other stations requiring ions, e.g., transfer, detack and preclean, if desired.

Figure 2:
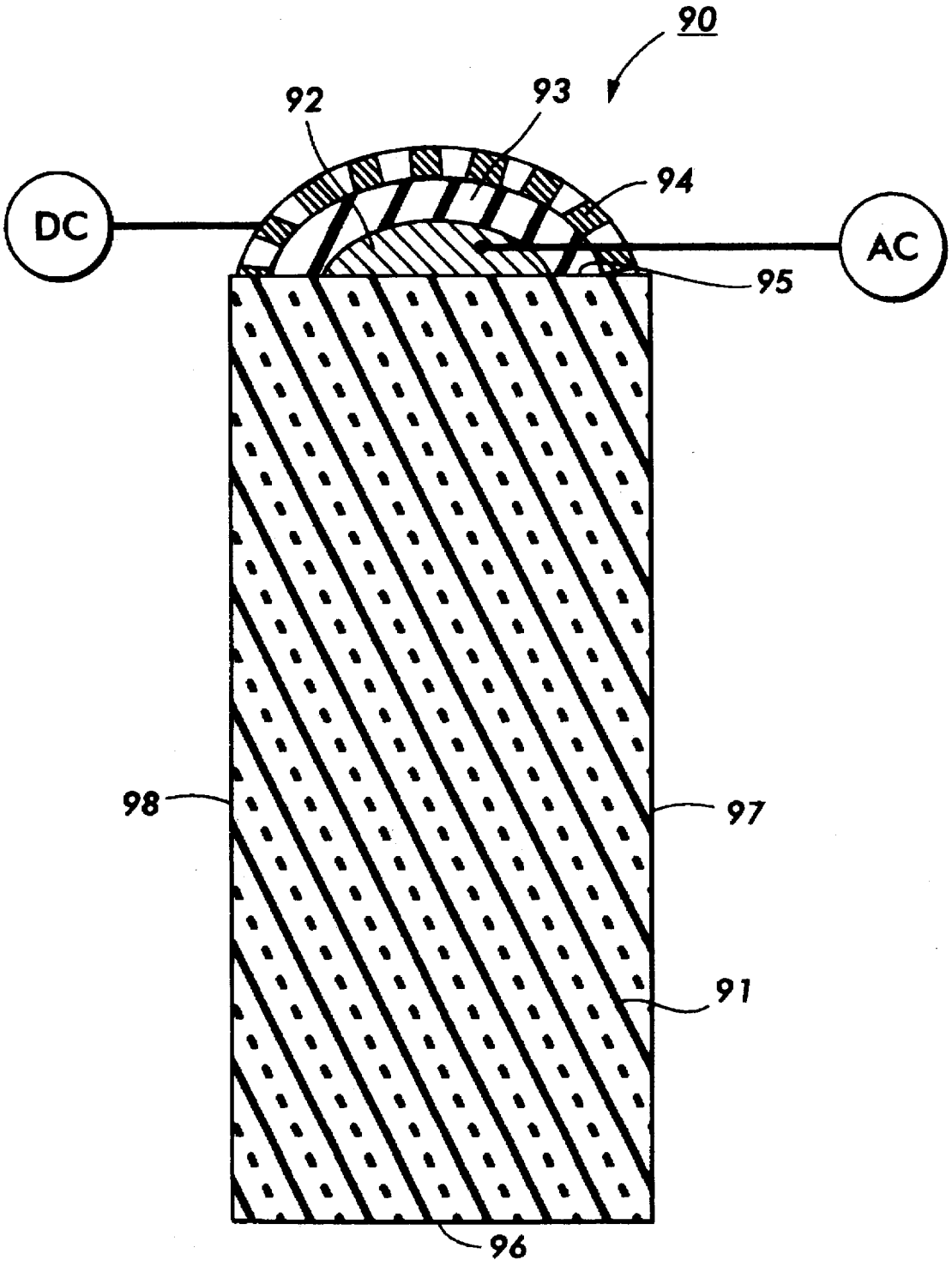

In a second embodiment of the present invention, as shown in FIG. 2, a micro sized ion generating device 90 comprises an insulated substrate 91 about 10 mils wide and having upstanding sides 97 and 98 and a top surface 95. An AC biased, 3 mil wide, conductor 92 is positioned on top surface 95 of insulated substrate 91 and serves as an AC source. An insulating layer of material 93 is 10 mils wide and covers conductor 92. A DC biased conductive screen pattern 94 is positioned atop insulating layer 93.

An advantage of the second embodiment is that fabrication of much smaller, and robust ion generating devices than heretofore possible has been made attainable by a simple method of employing additive direct writing technology. Additive writing technology is disclosed in a publication entitled Additive Direct Writing: An Emerging Technology by Micropen, Inc., 3800 Monroe Avenue, Pittsford, N.Y. 14534. The method comprises the steps of writing a 3 mil wide conductive line on a substrate edge, then writing over this line with an insulating layer, and then writing a screen pattern on top of the insulating layer of the previous step.

Another advantageous feature of the present invention is that the charging and/or transfer characteristics can be selected to meet charging and/or transfer requirements by selecting the appropriate width of the corona generating electrode and screen electrode. For example, the corona generated and available for charging is linearly related to the width as measured in the process direction, of the charging zone A. A 1 mm wide screen generates 6 times less charges than a 6 mm wide screen.

In operation for optimum performance, the present invention is placed in propinquity in relation to the charge receptor between from about 0.005" to about 0.25" from the charge receptor. The present invention offers improved size reductions and surface charge uniformity with smaller power supply requirements as compared to prior art devices. An ion generating charging device in accordance with the present invention was tested to charge a selenium plate with the ion generating charging device including a 10 mil support substrate, a 3 mil diameter conductor wire covered with a 10 mil insulator with a window screen conductive grid positioned on its surface.

While this invention has been described with reference to the structure disclosed herein, they are not confined to the details set forth and are intended to cover modifications and changes that may come within the spirit of the invention and scope of the claims.

What is claimed is:

1. A printing machine having an imaging member and a charging device for charging the imaging member, the charging device, comprising:

an insulated support substrate having a flat portion and an edge portion orthogonal to said flat portion of said insulated support substrate;

a coronode;

an insulated member in contact with and surrounding said coronode, said insulated member being mounted on said edge portion of said support substrate; and a conductive screen member positioned to hold said insulated member and said coronode on said edge portion of said insulated support substrate by extending over and around a portion of said insulated member while being attached to said insulated support substrate.

2. The printing machine of claim 1, wherein said coronode is AC biased.

3. The printing machine of claim 2, wherein said screen member is DC biased.

4. The printing machine of claim 3, wherein said insulated support substrate is about 0.01 to about 1 inch thick.

5. A micro sized charging device for applying charge to a charge receptive surface, comprising:

an insulated support substrate having a flat portion and an edge portion orthogonal to said flat portion of said insulated support substrate;

a conductive line positioned on top of and in contact with said edge portion of said insulated support substrate;

an insulating layer positioned on top of and in contact with said conductive line; and a conductive screen member positioned on top of and in contact with said insulating layer.

6. The charging device of claim 5, wherein said conductive line is AC biased.

7. The charging device of claim 6, wherein said screen is DC biased.

8. The charging device of claim 7, wherein said conductive line is about 3 mils wide, said conductive screen is about 10 mils wide, and said insulating layer is about 10 mils wide.

9. A method for producing a micro sized ion generating device by utilizing additive direct writing with the ion generating device being used to charge a surface of an imaging member, comprising the steps of:

a) providing an insulated substrate having a flat portion and an edge thereof orthogonal to said flat portion of said insulated support substrate;

b) providing a direct writing apparatus for additive direct writing on said insulated substrate;

c) writing a conductive line on said edge of said insulated substrate with said direct writing apparatus;

d) writing on top of said conductive line with an insulating layer with said direct writing apparatus; and e) then writing a screen pattern on top of said insulating layer.

10. The method of claim 9 further, including the step of AC biasing said conductive line.

11. The method of claim 10 further, including the step of DC biasing said screen pattern.

12. The method of claim 11, including the step of providing said insulated substrate with a 10 mil width, said conductive line with a width of 3 mils, and said conductive screen with a width of 10 mils.

* * * * *